United States Patent [19]

Takahashi et al.

[11] 4,404,620

[45] Sep. 13, 1983

[54] LUMINAIRE

[75] Inventors: Sadao Takahashi, Yokohama; Nobuo Matsushita, Tokyo, both of Japan

[73] Assignee: Toshiba Electric Equipment Corporation, Tokyo, Japan

[21] Appl. No.: 213,023

[22] Filed: Dec. 4, 1980

[30] Foreign Application Priority Data

Dec. 11, 1979 [JP] Japan ..... 54-160983

[51] Int. Cl.[3] ..... F21V 7/00

[52] U.S. Cl. ..... 362/304; 362/297; 362/346; 362/348

[58] Field of Search ..... 362/296, 346, 347, 348, 362/297, 298, 304

[56] References Cited

U.S. PATENT DOCUMENTS 3,040,994 6/1962 Anderson ..... 362/346
3,401,258 9/1968 Guth .
3,499,780 3/1970 Etherington et al. .
3,662,165 5/1972 Osteen et al. .
3,950,638 4/1976 Kent et al. .
4,081,667 3/1978 Lewin ..... 362/348
4,225,908 9/1980 Small, Jr. .

*Primary Examiner*—Donald P. Walsh
*Attorney, Agent, or Firm*—Oblon, Fisher, Spivak, McClelland & Maier

[57] ABSTRACT

A luminaire comprises a light source and a reflector which has an opening for emitting light and an apex opposed the opening, and which reflects light emitted from the light source in a desired direction. The reflector having a first area at the intermediate portion between the opening and the apex thereof consisting of a plurality of reflecting surface units with inclined surfaces located at both sides thereof, and a second area disposed at least partially between the intermediate portion and the opening consisting of hammer tone finished reflecting surfaces formed at least partially on a portion located nearer to the opening for emitting light than the first area is located to.

30 Claims, 11 Drawing Figures

LUMINAIRE

BACKGROUND OF THE INVENTION

1. Field of the Invention

The present invention relates to a luminaire and, more particularly, to a medium angle type floodlight which produces a medium beam light with a one-tenth-peak spread of substantially 45°-65°.

2. Description of the Prior Art

Floodlights are generally classified according to their applications into narrow angle type, medium angle type, and wide angle type. The medium angle type floodlight luminaire, as described above, has a one-tenth-peak spread of substantially 45°-65° (represented by twice the angle from the optical axis for providing the luminous intensity which is one-tenth of the peak luminous intensity) and may be widely used than the wide angle type floodlight luminaire is used. Medium angle type floodlight luminaires are used, for example, in baseball fields, tennis courts, school grounds, parking lots, and so on. It has been found from experience that the one-tenth-peak spread of the medium angle type floodlight luminaire is preferable within an angle range of about 45°-65° from the perspective of the uniformity of illuminance and the lighting effectiveness.

A reflector for a conventional medium angle type floodlight luminaire is generally made of super pure aluminum and is paraboloid in contour or very close to it. The reflecting surface is processed with a matte finish or with a hammer tone finish consisting of a plurality of substantially hemispherical recesses in its entirety, or is formed to have a plurality of small triangular or rectangular reflecting surface units in its entirety. The reflecting surface is either electrolytically polished or chemically polished. The conventional reflectors of such constructions are insufficient in the one-tenth-peak spread or in the beam factor (the ratio of beam flux within one-tenth-peak spread and the total lamp lumen). For example, with a reflector whose reflecting surface is processed with the matte finish in its entirety, the light falling on the reflector surface is irregularly reflected by the reflecting surface so that a medium beam is obtained. However, the beam factor is lower than that of a specular reflector because of lower reflectance.

The reflector having the reflecting surface processed with the hammer tone finish consisting of the plurality of substantially hemispherical recesses in its entirety has a sufficient specularity that it provides a beam factor as good as that of the above-mentioned reflector. However, with this reflector, it is not possible to obtain a one-tenth-peak spread of over 45° generally. For obtaining a one-tenth-peak spread of substantially 45°-65° with the reflector having the plurality of recesses, the depth of the each recess must be greater than the diameter of the recess on the reflecting surface. This raises the cost of forming projections for making the above recesses in a dies for forming the reflector, increasing the manufacturing cost for the dies and the reflector itself. Further, as the depth of the recesses increases, the actual depth of the recesses of the reflector formed by the dies and the height of the projections formed in the dies tend not to correspond with each other, so that the dimensions of the reflector obtained actually may differ from that of the design. With a recess having still greater depth, the irregular reflection tends to increase in the recess so that the beam factor and the luminaire efficiency are decreased.

With the reflector having the reflecting surface being formed to have the plurality of reflecting surface units in its entirety, the shape of each reflecting surface unit is complex and the number of the units is relatively great. Accordingly, an expensive hydraulic pressing device must be used for forming a plurality of such reflecting surface units at the same time. The use of the hydraulic pressing device leads to a higher manufacturing cost. Further, the plurality of reflecting surface units formed over the entire reflecting surface causes irregular reflection among the reflecting surface units themselves, so that the beam factor and the luminaire efficiency are decreased.

SUMMARY OF THE INVENTION

The object of the present invention is to provide a luminaire for a floodlight which is capable of providing medium beam which is higher in beam factor and luminaire efficiency than that of a conventional one and which enables a lower manufacturing cost.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENTS

The embodiments of this invention will now be described with reference to the accompanying drawings.

Figure 1:
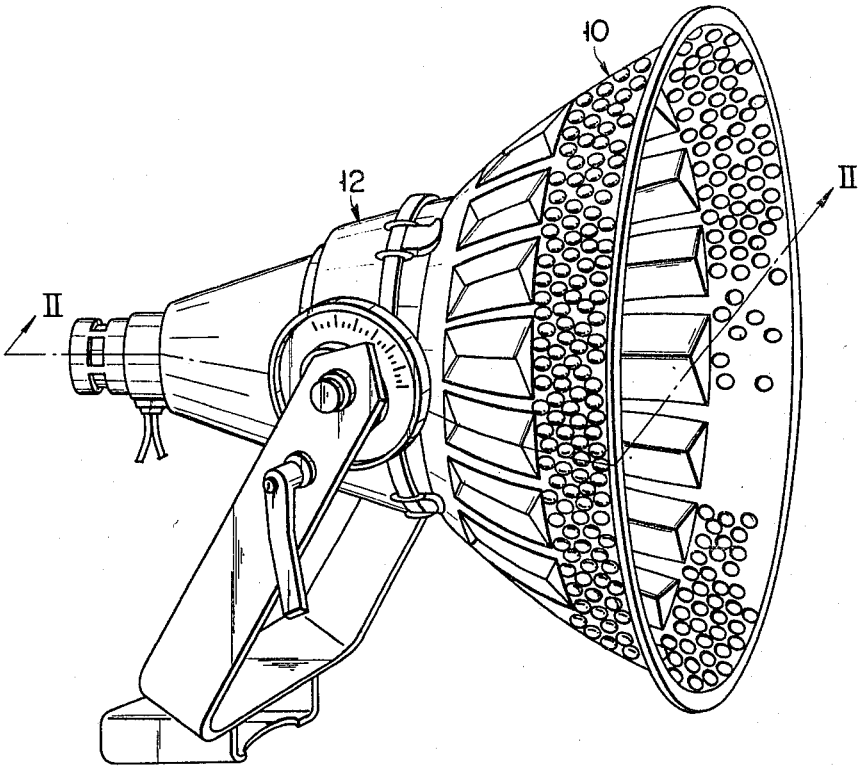
FIG. 1 is a perspective view schematically showing a luminaire according to an embodiment of the present invention.
Figure 2:
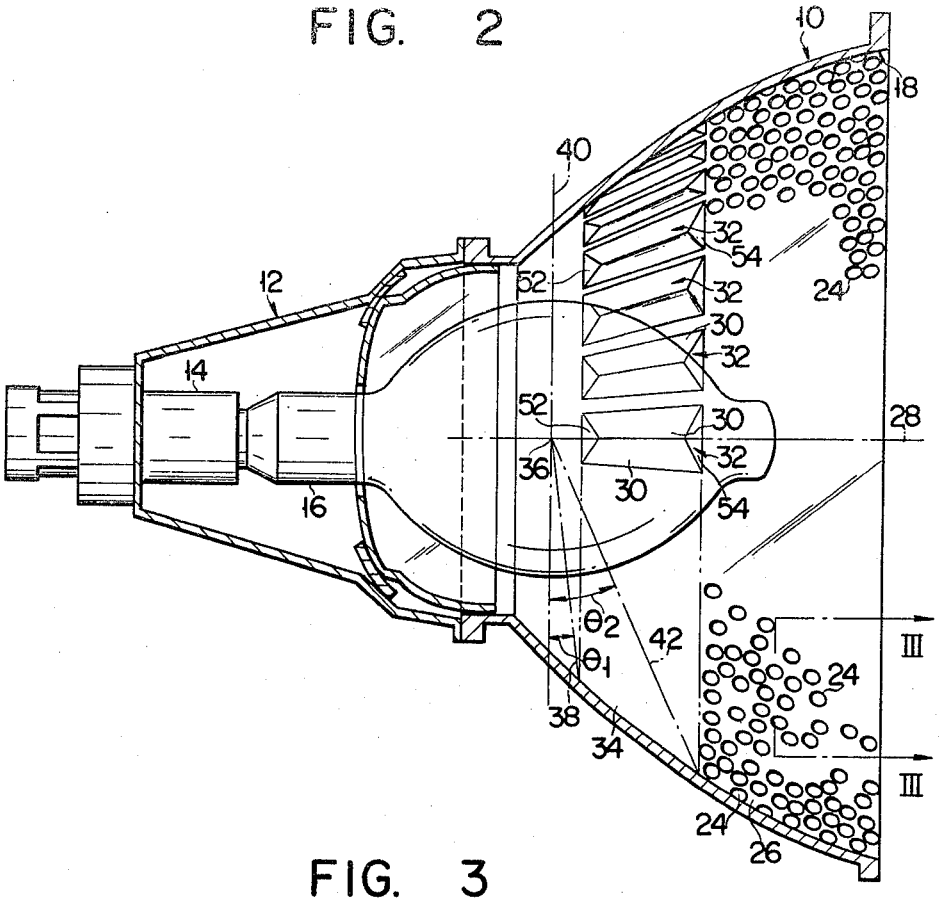
FIG. 2 is a sectional view taken on line II—II of FIG. 1.

The luminaire shown in FIG. 1 is a floodlight and has a reflector 10 and a reflector holding member 12 for detachably holding the reflector 10. The reflector holding member 12 has, as shown in FIG. 2, a light source holding means 14, and the light source holding means 14 has a light source 16. In this embodiment, the light source holding means 14 is a socket electrically connected to an external power source (not shown), and the light source 16 is a high pressure mercury vapor lamp which is a kind of high intensity discharge lamp. As the light source 16, a high pressure sodium lamp or a metal halide lamp may alternatively be used.

The reflector 10, in this embodiment, has a revolved paraboloid shape. The reflector 10, as shown in FIG. 2, gradually opens out from the rear end toward the opening for emitting light. A reflecting surface 18 of the reflector 10 is opposed to the light source 16 as shown in FIG. 2 and reflects the light emitted from the light source 16 to a desired direction.

In this embodiment, the reflector 10 comprises a multi-layer structure of a base member 20 formed of super pure aluminum plate, and a protective film 22 obtained by anode oxidation of the base member 20 after electrolytic polishing. The reflecting surface 18 described above has sufficient specularity and high reflectance.

Figure 3:
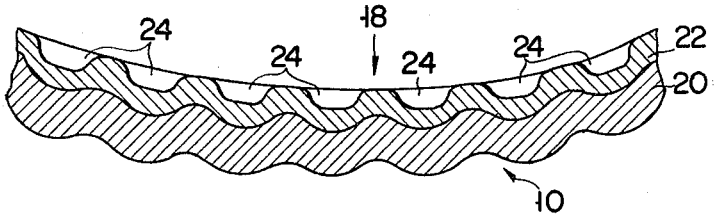
FIG. 3 is sectional view taken on line III—III of FIG. 2.

The reflector 10 of the luminaire of the embodiment of the present invention, as shown in detail in FIGS. 2 and 3, includes a first area 26 consisting of a hammer tone finished reflecting surface having a plurality of recesses 24 of hemispherical shape. The first area is located at least near the front of the reflector 10 for emitting light. In this embodiment, the first area 26 is arranged to form an annular shape within a plane perpendicular to an optical axis 28 of the reflector 10.

The one-tenth-peak spread of the reflector whose entire reflecting surface is processed with the hammer tone finish is not over 45° as described in the Background of the Invention of this specification.

The reflecting surface 18 of the reflector 10 of the floodlight luminaire of the present invention, as shown in FIG. 2 in particular, includes a second area 34 which is arranged at an intermediate part of the reflecting surface. The second area 34 is located adjacent to the first area 26 and more spaced apart from the opening of the reflector 10 than first area 26 is space apart from the opening and which has a plurality of reflecting surface units 32 having inclined surfaces 30 at both sides thereof.

In this embodiment, the plurality of reflecting surface units 32 are arranged to make an annular shape at equal intervals in a plane perpendicular to the central axis 28 of the reflector 10, as shown particularly in FIG. 2. The ridgelines formed between the inclined surfaces 30 at both sides of the reflecting surface units 32 are arranged radially as viewed from the front of the reflector 10.

One end of the reflecting surface unit 32 is so located, as shown in FIG. 2, that a first line segment 38 connecting this one end with a light center 36 of the light source 16 forms an angle $\theta_1$ of 10° with respect to a reference plane 40 which is perpendicular to the central axis 28 of the reflector 10 and which includes the light center 36. The other end of the reflecting surface unit 32 is so located, as shown in FIG. 2, that a second line segment 42 connecting the other end with the light center 36 of the light source 16 forms an angle $\theta_2$ of 30° with respect to the reference plane 40°.

The angles $\theta_1$ and $\theta_2$ were set in the manner to be described below.

Figure 5:
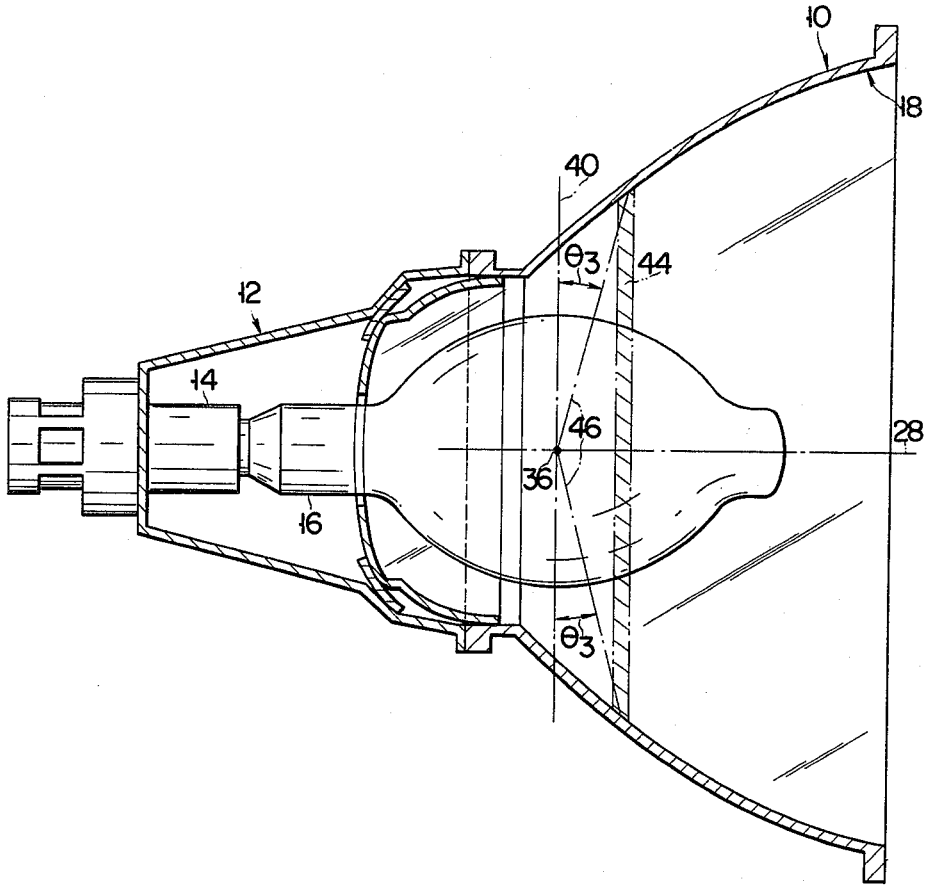
FIG. 5 is a sectional view showing the reflector in which the hammer tone finish and reflecting surface units are removed from the embodiment of the present invention at the section of FIG. 2.
Figure 6:
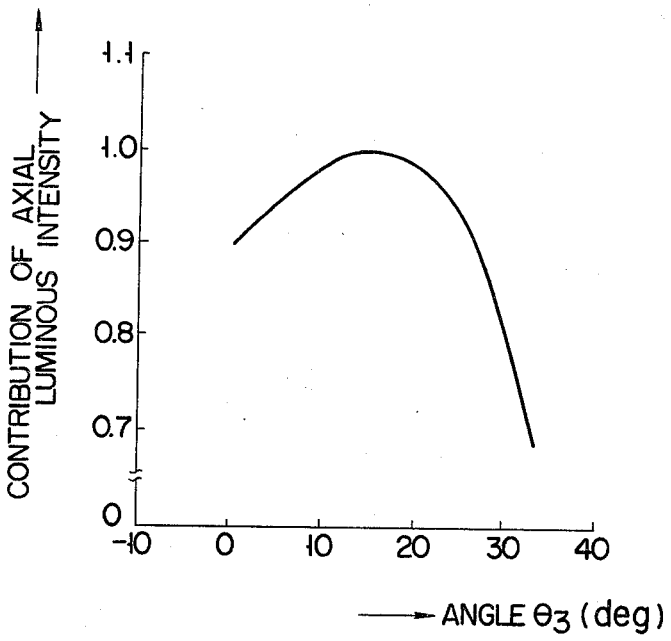
FIG. 6 is a graph showing the contribution of the axial luminous intensity taking an angle $\theta_3$ shown in FIG. 5 as a reference.

The inventors of this invention have conducted experiments concerning the optical path of the light emitted from the light source 16 when the reflector 10 of the multilayer structure is applied to a reflector which has the revolved paraboloid shape as the basis of the reflector 10 of medium angle type and which does not have reflecting surface units 32, as shown in FIG. 5. As a result of these experiments, the characteristics as shown in FIG. 6 were obtained. The above characteristics show the contribution of axial luminous intensity of the light reflected by any minute surface 44 of the reflecting surface 18 which is located in a plane perpendicular to the central axis 28. The location of the minute surface 44 is shown by an angle $\theta_3$ between a line segment 46 connecting the light center 36 with the minute surface 44 and the reference plane 40, as shown in FIG. 5. When these characteristics were studied, the above-mentioned contribution was maximum at near $\theta_3=15°$. The shape and the location of the reflecting surface units 32 are set by looking for the optical path of the light reflected by the reflecting surface 18 near around $\theta_3=15°$ by calculation. The reflecting surface units 32 function to drop the axial luminous intensity of the light reflected by the reflector and to widen the one-tenth-peak spread. It was learned that the angle $\theta_1$ is preferably within a range of about 0°–15° and the angle $\theta_2$ is preferably within a range of about 20°–30° for obtaining the medium angle type luminous intensity distribution with the combination of the reflecting surface units 32 and the hammer tone finished reflecting surface located near the opening for emitting light. It was further learned that ideal medium angle type luminous intensity distribution are obtained when the angle $\theta_1$ is 10° and the angle $\theta_2$ is 30°.

Figure 7:
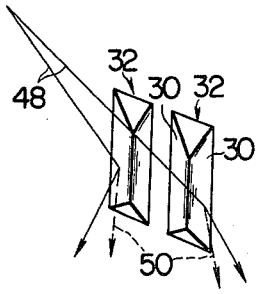
FIG. 7 is an enlarged view of the reflecting surface units for explaining its functions.
Figure 9:
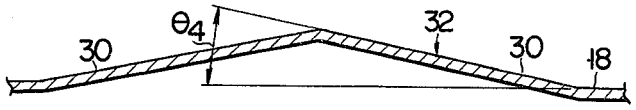
FIG. 9 is a sectional view taken on line IX—IX of FIG. 4.

With this construction, as shown in FIG. 7, incident light 48 emitted from the light source 16 is reflected by the inclined surfaces 30 at both sides of the reflecting surface units 32. The inclined light is reflected by the inclined surfaces 30 obliquely toward the front, as shown by the solid line, as the components forming right angle with the central axis of the reflecting surface units 32 are synthesized according to the angle which is between surfaces 30 and the reflecting surface 18 of the reflector 10. In FIG. 7, reflected light 50 obtained when the reflecting surface units 32 are not formed is shown by the broken line. The light reflected by the inclined surfaces 30 and shown by the solid line is scattered, as shown in FIG. 7, more than the reflected light 50 shown by the broken line.

Figure 8:
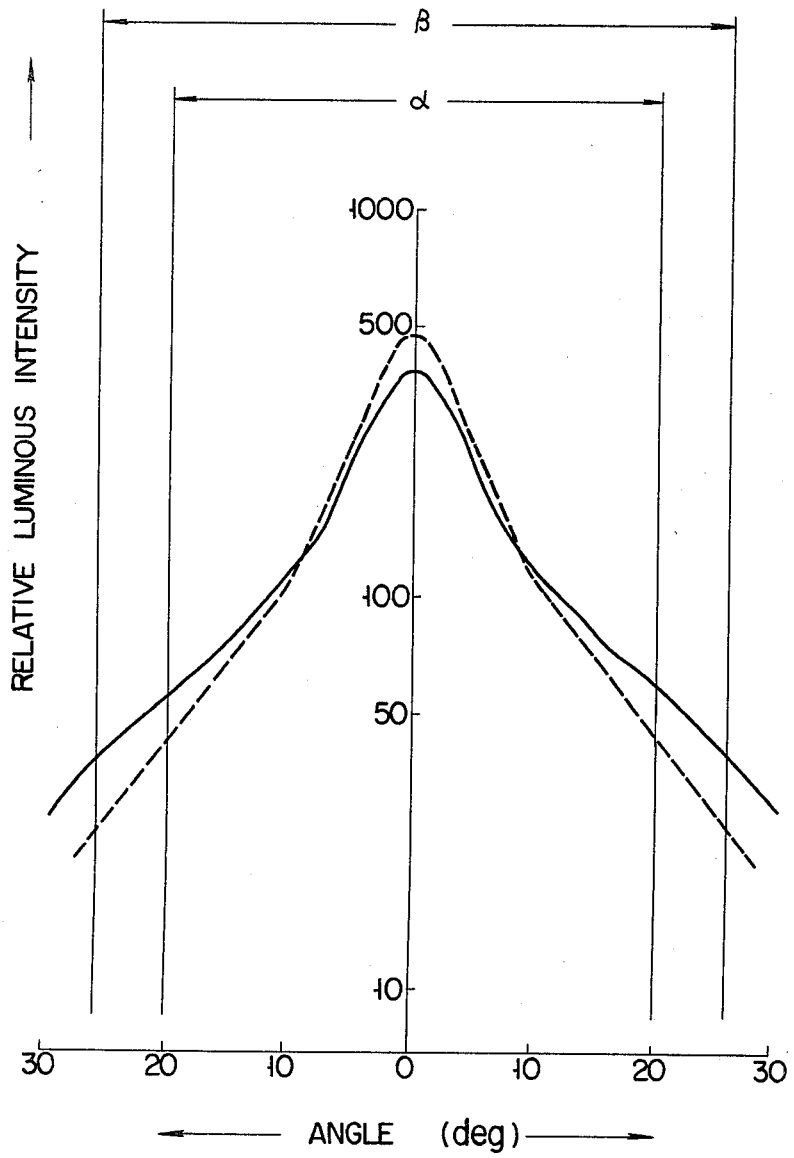
FIG. 8 is a graph in which the luminous intensity distribution curve of the luminaire of the embodiment of the present invention is shown by the solid line, and the luminous intensity distribution curve of the conventional luminaire having the reflecting surface processed with hammer tone finish in its entirety or the reflecting surface formed to have reflecting surface units in its entirety is shown by the broken line.

The light from the light source 16 reflected by the first area 26 and the second area 34 of the reflecting surface 18 produces a luminous intensity distribution curve as shown in FIG. 8 by the solid line. The one-tenth-peak spread of the solid line luminous intensity distribution curve is 51° which correspond to the ideal value of the one-tenth-peak spread for a medium angle type floodlight luminaire. FIG. 8 also shows the luminous intensity distribution curve for a conventional reflector in which a hammer tone finish consisting of a plurality of recesses are applied over the entire reflecting surface. The one-tenth-peak spread of the luminous intensity distribution curve shown by the broken line is 40°, which does not reach the ideal value of the one-tenth-peak apread for a medium angle type floodlight luminaire. The beam factor of the luminous intensity distribution curve shown by the solid line is higher than that of the luminous intensity distribution curve shown by the broken line.

According to the principles of the present invention, it is preferable that the angle $\theta_4$ between the inclined surfaces 30 and the reflecting surface 18 be within a range of about 5°–20°, most preferably 10°.

Figure 4:
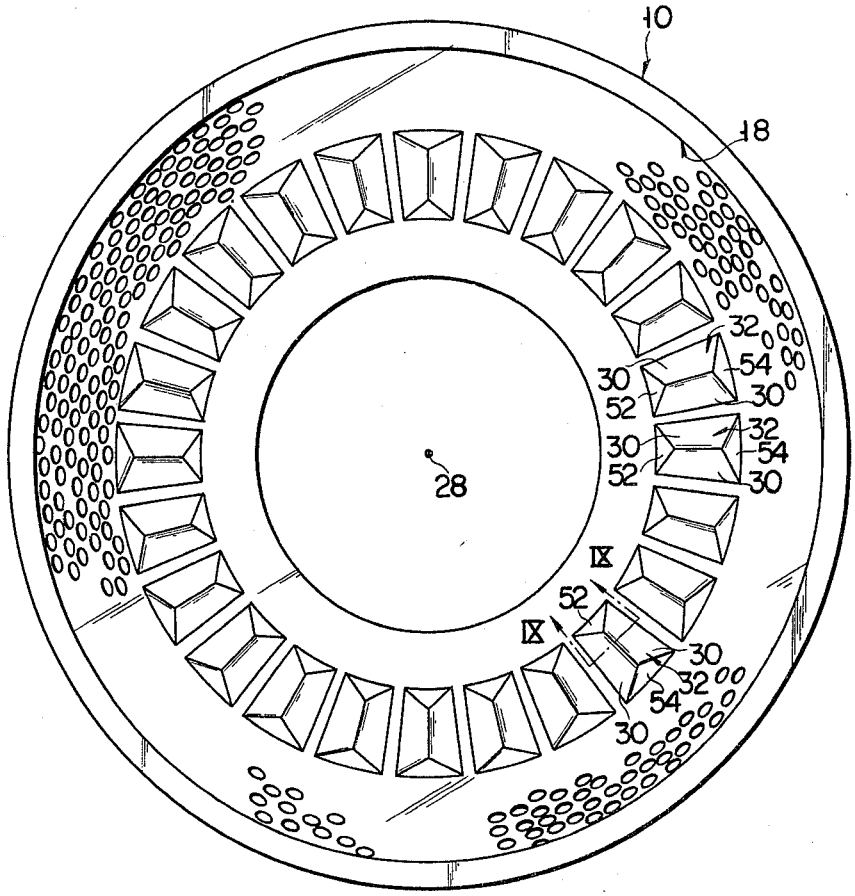
FIG. 4 is a front view schematically showing the reflector of the luminaire shown in FIG. 1.

According to the principles of the present invention, it is preferable that each of the reflecting surface units 32 of the second area 34, as shown in FIGS. 2 and 4, has a first subinclined surface 52 located near the one end of each reflecting surface unit 32 and inclined toward the opening of the reflector 10 from the above-mentioned one end to the ridgeline formed between the above-mentioned inclined surfaces 30, and a second subinclined surface 54 located near the other end of each reflecting surface unit 32 and inclined toward the above-mentioned back of the reflector 10 from the above-mentioned other end to the above-mentioned ridgeline.

It is further known from experience that the diameter of the plurality of recesses 24 of the first area 26 are preferably about 2–about 20 mm and the depth of the plurality of recesses 24 are preferably about 0.1–about 2.0 mm at the reflecting surface 18 for making the manufacture of the dies easy, lowering the manufacturing cost of the dies, and improving the drawing characteristics. The diameter is most preferably 3–6 mm and the depth is most preferably 0.2–0.5 mm.

In this embodiment, the plurality of recesses 24 of the first area 26 are simultaneously formed when forming the reflector 10 from the aluminum base member having a plate like shape by drawing. Thereafter, the plurality of reflecting surface units 32 of the second area 34 are formed by press work which is generally adopted for this kind of processing. The plurality of reflecting surface units 32 of the luminaire of the present invention may be formed by conventional press work as described above since they are smaller in number than reflecting surface units of the conventional medium angle type luminaire described above. Thus, the need for an expensive hydraulic pressing device may be eliminated, so that the manufacturing cost of the reflector 10 may be decreased as compared with conventional reflectors.

When the angles $\theta_1$ and $\theta_2$ of the ends of the each reflecting surface unit 32 of the second area 34 are gradually decreased and the area of the first area 26 having the plurality of recesses 24 is gradually increased, the axial luminous intensity of the light reflected by the reflector 10 gradually increases, and the one-tenth-peak spread falls out of the range of about 50°–about 60° being the ideal value for the one-tenth-peak spread of the medium angle type floodlight luminaire.

In this embodiment, since the plurality of reflecting surface units 32 of the second area 34 are spaced apart from each other at equal intervals in a circumferential direction as shown in FIGS. 2 and 4, undesirable irregular reflection is not caused, and the beam factor and the luminaire efficiency are improved.

A modification of the embodiment of the present invention will now be described.

Figure 10:
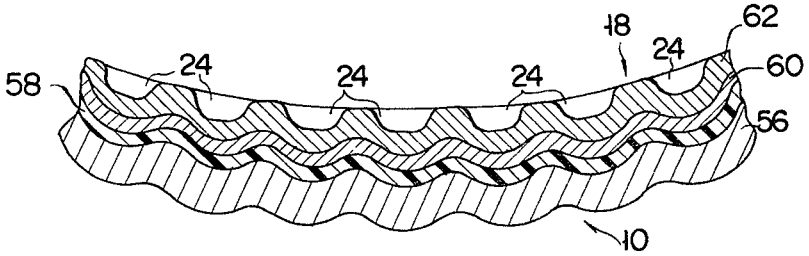
FIG. 10 is a sectional view showing a modification of the reflecting surface of the reflector of the luminaire according to the embodiment of the present invention at the section of FIG. 3.

The part which is different from the above-mentioned embodiment is the construction of the reflecting surface 18 of the reflector 10. In this modification, the reflecting surface 18, as shown in FIG. 10, has a base member 56 made of steel, low purity aluminum or a heat-resistant resin. In this embodiment, an undercoat 58 of a heat-resistant synthetic resin is coated on the base member 56. The heat-resistant synthetic resin is silicone in this modification. On the undercoat, as shown in FIG. 10, is coated aluminum by vacuum evaporation, and the coated aluminum forms a high reflecting film 60. An inorganic material is coated on the high reflecting film 60 by vacuum evaporation, and the inorganic material thus coated forms a transparent protective film 62. In this modification, the inorganic material is quartz glass ($SiO_2$). The undercoat 58 functions to increase the strength of adhesion of the high reflecting film 60 to the base member 56 and to increase the smoothness of the surface of the high reflecting film 60. This then leads to an increase of the specularity of the surface of the transparent protective film 60, that is, the specularity of the reflecting surface 18 of the reflector 10 as compared with that of the reflecting surface 18 of the construction of the embodiment shown in FIG. 3. The undercoat 58 is not indispensable, thus it may be omitted. The base member 56, the high reflectivity film 60, and the transparent protective film 62 constitute a multilayer structure.

The total reflectance of the reflecting surface 18 of the modification of the construction described above is about 1.1 times that of the reflecting surface 18 of the first embodiment of the present invention. When the specularities of both reflecting surfaces are compared taking the 20 degrees gloss as defined in JIS Z8741 (Japanese Industrial Standard), as the standard, the specularity of the former is about 1.5 times that of the latter. Further, the transparent protective film 62 of inorganic material, for example quartz glass, is excellent in weatherproof characteristics. Thus, the excellent specularity and total reflectance of the reflecting surface 18 of the reflector 10 of the modification do not change over an extended period of time. Thus, the beam factor of the reflector 10 of the modification is higher than that of the first embodiment.

To summarize, the luminaire of the present invention comprises a light source; and a reflector which has an opening for emitting light and which reflects light emitted from the light source in a desired direction; said reflector having a first area at the medium portion thereof consisting of a plurality of reflecting surface units with inclined surfaces located at both sides thereof, and a second area consisting of hammer tone finished reflecting surfaces formed at least partially on a portion located nearer to the opening for emitting light than the first area is located to. Therefore, the various defects of the two conventional reflectors as described above, that is, the reflector with hammer tone finished reflecting surfaces over the entirety of the reflecting surface, and the reflector with a plurality of reflecting surface units over the entirety of the reflecting surface, are cancelled so that medium angle type luminous intensity distribution of higher beam factor may be obtained and a lower manufacturing cost may be attained than with the conventional reflectors.

The embodiment and modifications described above are only for the purpose of explanation and are not intended to limit the present invention in any manner. It is, therefore, to be understood that various modifications and changes are contemplated to be included within the scope of the present invention.

Figure 11:
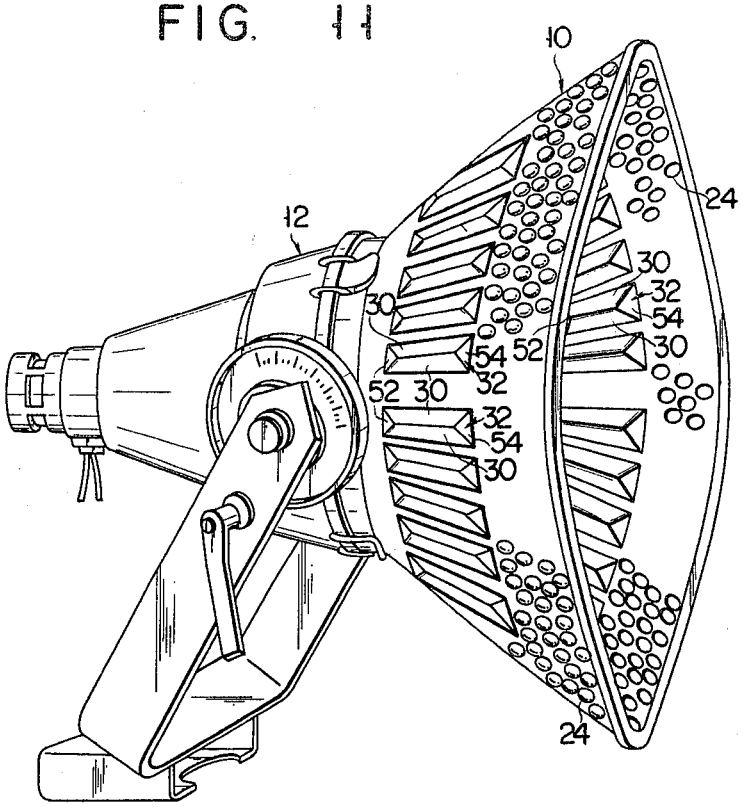
FIG. 11 is a perspective view schematically showing a modification of the reflector of the luminaire of the embodiment of the present invention.

For example, the reflector may be a hexagonal or quadrangular pyramid, as shown in FIG. 11.

The reflecting surface units 32 may be arranged at equal intervals in the circumferential direction or may be formed to be continuous.

Further, the high reflecting film 60 may be formed by vacuum evaporation of silver. The transparent protective film 62 may be formed by vacuum evaporation of $Al_2O_3$.

What is claimed as new and desired to be secured by Letters Patent of the United States is:

1. A luminaire comprising:

a light source;

a reflector surrounding said light source and reflecting light emitted by said light source to a desired direction;

said reflector including a first region formed on an inner surface of said reflector located at a first position adjacent a light projecting end portion;

a second region formed on said inner surface of said reflector located between said first region and a second position adjacent a base end portion of said reflector and having a smooth reflecting surface;

a plurality of substantially identical reflecting surface units positioned in said second region, each having slanted opposite side portions which intersect each other, wherein said plurality of reflecting surface units are arranged in a circumferential direction at fixed intervals such that a plurality of smooth reflecting surface portions are defined between each two adjacent reflecting surface units and each connect said first and second positions and wherein a first imaginary straight line segment connecting a first end of said reflecting surface units and a light center of said light source forms a first fixed angle with a reference plane normal to an axis of said reflector and containing said light center and a second imaginary straight line segment connecting a second end of said reflecting surface units and light center of said light source forms a second fixed angle with said reference plane; and said first region further comprises a plurality of hammer tone finished reflecting surfaces.

2. A luminaire according to claim 1, wherein said first fixed angle of said first imaginary straight line segment further comprises a fixed angle within a range between about 0° and 15°, and said second fixed angle of said second imaginary straight line segment comprises a fixed angle within a range between about 20° and about 30°.

3. A luminaire according to claim 1, wherein said reflector further comprises a multi-layer structure comprising a base member of super pure aluminum and a protective film formed by electrolytic polishing said base member and thereafter coating said base member by anodic oxidation.

4. A luminaire according to claim 1, wherein said reflector further comprises a multi-layer structure having a base member, a high reflecting film coating on said base member, and a transparent protective film formed on said high reflectivity film.

5. A luminaire according to claim 4, wherein said base member further comprises a metal member, said high reflecting film is formed by evaporation of aluminum, and said transparent protective film further comprises an inorganic material.

6. A luminaire according to claim 5, wherein said inorganic material further comprises quartz glass.

7. A luminare according to claim 2, wherein said reflector further comprises a multi-layer structure including a base member of super pure aluminum and a protective film formed by electrolytic polishing said base member and thereafter coating said base member by anodic oxidation.

8. A luminaire according to claim 2, wherein said reflector further comprises a multi-layer structure having a base member, a high reflecting film coated on said base member, and a transparent protective film formed on said high reflectivity film.

9. A luminaire according to claim 8, wherein said base member further comprises a metal member, said high reflecting film is formed by evaporation of aluminum, and said transparent protective film further comprises an inorganic material.

10. A luminaire according to claim 9, wherein said inorganic material is quartz glass.

11. A luminaire according to claim 2, wherein said reflector has a shape gradually opening from said base end thereof toward said light projecting end, said plurality of reflecting surface units are arranged to form an annular shape in a plane perpendicular to said optical axis of said reflector, and ridgelines formed between said inclined opposite side portions of said plurality of reflecting surface units are arranged radially as viewed from the front of said opening of said reflector.

12. A luminaire according to claim 11, wherein said reflector further comprises a quadratic surface of revolution.

13. A luminaire according to claim 11, wherein said reflector further comprises a quadrangular pyramid shaped reflector.

14. A luminaire according to claim 11, wherein each of said plurality of reflecting surface units has a first sub-inclined surface which is inclined from said first end to said ridgelines formed between said inclined opposite side portions toward said opening of said reflector, and a second sub-inclined surface located which is inclined from said second end to said ridgeline toward said base end of said reflector.

15. A luminaire according to claim 2, wherein said first imaginary straight line segment crosses said reference plane at an angle of 10° and said second imaginary straight line segment crosses said reference plane at an angle of 30°.

16. A luminaire according to claim 2, wherein each one of said inclined opposite side portions cross said smooth portion of said second region of said inner surface of said reflector at an angle of about 10°–about 15°.

17. A luminaire according to claim 16, wherein each one of said inclined opposite side portions cross said smooth portion of said region of said inner surface of said reflector at an angle of 10°.

18. A luminaire according to claim 1, wherein said reflector is of a shape gradually opening from said base end thereof to said light projecting end, and said hammer tone finished reflecting portion is arranged to form an annular shape in a plane perpendicular to said optical axis of said reflector and along said optical axis.

19. A luminaire according to claim 18 wherein said first imaginary straight line segment connecting said first end of said reflecting surface unit and the light center of said light source crosses, at an angle of about 0° to about 15°, a reference plane including said light center and perpendicular to said optical axis of said reflector, and a second imaginary straight line segment connecting said second end of said reflecting surface unit and said light center crosses said reference plane at an angle of about 20° to about 30°.

20. A luminaire according to claim 19, wherein said plurality of reflecting surface units are arranged to form an annular shape in a plane perpendicular to said optical axis of said reflector and ridgelines formed between said inclined surfaces at both sides of said plurality of reflecting surfaces are arranged radially as viewed from the front of said opening of said reflector.

21. A luminaire according to claim 20, wherein said reflector further comprises a quadratic surface of revolution.

22. A luminaire according to claim 20, wherein said reflector further comprises a quadrangular pyramid shaped reflector.

23. A luminaire according to claim 20, wherein each one of said plurality of reflecting surface units further comprises a first subinclined surface which is inclined from said first end to said ridgeline toward said opening of said reflector, and a second subinclined surface which is inclined from said light projecting end to said ridgeline toward said base end of said reflector.

24. A luminaire according to claim 19, wherein said first imaginary straight segment crosses said reference plane at an angle of 10° and said second imaginary straight line segment crosses said reference plane at an angle of 30°.

25. A luminaire according to claim 19, wherein each one of said inclined opposite side portions cross said smooth portion of said second region of said inner surface of said reflector at an angle in a range of about 5° to about 20°.

26. A luminaire according to claim 25, wherein each one of said inclined opposite side portions cross said smooth portion of said region of said inner surface of said reflector at an angle of about 10°.

27. A luminaire according to any one of claims 11 to 26, wherein said reflector further comprises a multi-layer structure having a base member of super pure aluminum and a protective film formed by electrolytic polishing said base member and thereafter coating said base member by anodic oxidation.

28. A luminaire according to any one of claims 11 to 26, wherein said reflector is of a multi-layer structure comprising a base member, a high reflecting film coated on said base member, and a transparent protective film formed on said high reflectivity film.

29. A luminaire according to claim 28, wherein said base member further comprises a metal member, said high reflecting film is formed by evaporation of aluminum, and said transparent protective film further comprises an inorganic material.

30. A luminaire according to claim 29, wherein said inorganic material further comprises quartz glass.

* * * * *